United States Patent [19]

Takahashi et al.

[11] 4,119,952

[45] Oct. 10, 1978

[54] APPARATUS FOR MONITORING PHOTOGRAPHIC PROCESSING LIQUID

[75] Inventors: Yutaka Takahashi; Yoshio Hakamata, both of Tokyo; Masamitu Konno, Hino, all of Japan

[73] Assignee: Fuji Photo Film Co., Ltd., Minaniashigara, Japan

[21] Appl. No.: 770,780

[22] Filed: Feb. 22, 1977

[30] Foreign Application Priority Data

Feb. 20, 1976 [JP] Japan ..... 51-17510

[51] Int. Cl.[2] ..... G08B 1/00

[52] U.S. Cl. ..... 340/309.1; 340/309.4; 354/297; 354/298; 340/168 R

[58] Field of Search ..... 340/309.1, 309.4, 168 R; 354/297, 298; 137/624.15

[56] References Cited

U.S. PATENT DOCUMENTS

| | | | |
|---|---|---|---|
| 3,780,315 | 12/1973 | Blakeslee | 340/309.4 |
| 3,822,723 | 7/1974 | Crowell | 354/297 |
| 3,973,251 | 8/1976 | Stephans | 340/309.4 |

*Primary Examiner*—Harold I. Pitts

[57] ABSTRACT

An apparatus for monitoring photographic processing liquid composed of a timer to determine the length of time which has passed after the renewal of the processing liquid, a counter to determine the amount of the photographic film which has been already processed and an alarm light which is responsive to either timer or counter when having reached the respective predetermined position for lighting to indicate that the photographic processing liquid must be renewed. Thanks to the monitoring in terms of the "effective length of time" of the processing liquid and of the total amount of the photographic film already processed, it is assured that the processing liquid is renewed before it has been exhausted and has lost the processing capability.

4 Claims, 2 Drawing Figures

APPARATUS FOR MONITORING PHOTOGRAPHIC PROCESSING LIQUID

BACKGROUND OF THE INVENTION

1. Field of the Invention

This invention relates to an apparatus for monitoring the photographic processing liquid for use in a camera processor. The photographic processing liquid such as the developing liquid if exposed to air at an elevated temperature, will be oxidized, and the amount of oxides in the liquid will increase with time. Also, in the course of developing strip of photographic film halogen ions will result in the developing liquid. These oxides and halogen ions in the liquid will suppress the developing effect, accordingly lowering the developing capability of the liquid. In this connection it is necessary that the developing liquid is monitored in terms of the length of timer after the renewal of the liquid and the amount of photographic film already processed to determine when the liquid is to be renewed for keeping the developing capability of the liquid at a constant level.

2. Description of the Prior Art

A conventional apparatus for monitoring the photographic processing liquid operates so that it determines the pH value of the developing liquid and automatically renews the liquid so as to maintain the pH of the total liquid at a given constant value. The apparatus of this type is suitable for use in a large-sized camera processor for commercial use. The apparatus performs the monitoring of the developing liquid automatically, and therefore it is convenient. The structure of the apparatus, however, is much complicated, and accordingly the apparatus is expensive. Another conventional monitoring apparatus uses a counter to determine the length of the processing photographic film so as to determine when the developing liquid is renewed. The indirect indication of the renewal time on the counter is somewhat difficult to discern. Each of the conventional monitoring apparatus mentioned above monitors the processing liquid in terms of the amount of the processed photographic film. This monitoring is not proper to the infrequent use of the camera processor, as for instance in an office. Because the camera processor installed in the office is infrequently used, the effective period of time of the developing liquid expires before the amount of the photographic film which has been actually processed within the "effective period of time" reaches the amount of the photographic film which would have been processed if the apparatus had been continuously used for the "effective period of time". In this connection as long as the monitoring is performed in terms of the amount of the photographic film processed, it is likely that the liquid which has lost the developing capability is used.

SUMMARY OF THE INVENTION

In view of the above, the object of this invention is to provide an apparatus for monitoring the processing liquid in terms both of the amount of the processed photographic film and of the "effective period of time" of the processing liquid.

A monitoring apparatus according to this invention comprises a timer for determining the length of time which has passed after the liquid was put for use and a counter for counting the strips of photographic film which have been processed. In operation, when the timer or the counter detects the exhausted state of the developing liquid, the alarm lamp is lit to indicate the renewal time of the developing liquid. Thank to the monitoring of the developing liquid in terms both of the amount of the processed photographic film and the "effective period of time" of the developing liquid, the developing capability of the liquid is maintained at a given constant level at all times, and as the renewal indication is given by the alarm lamp, the user is easy to discern.

DESCRIPTION OF THE PREFERRED EMBODIMENT

Figure 1:
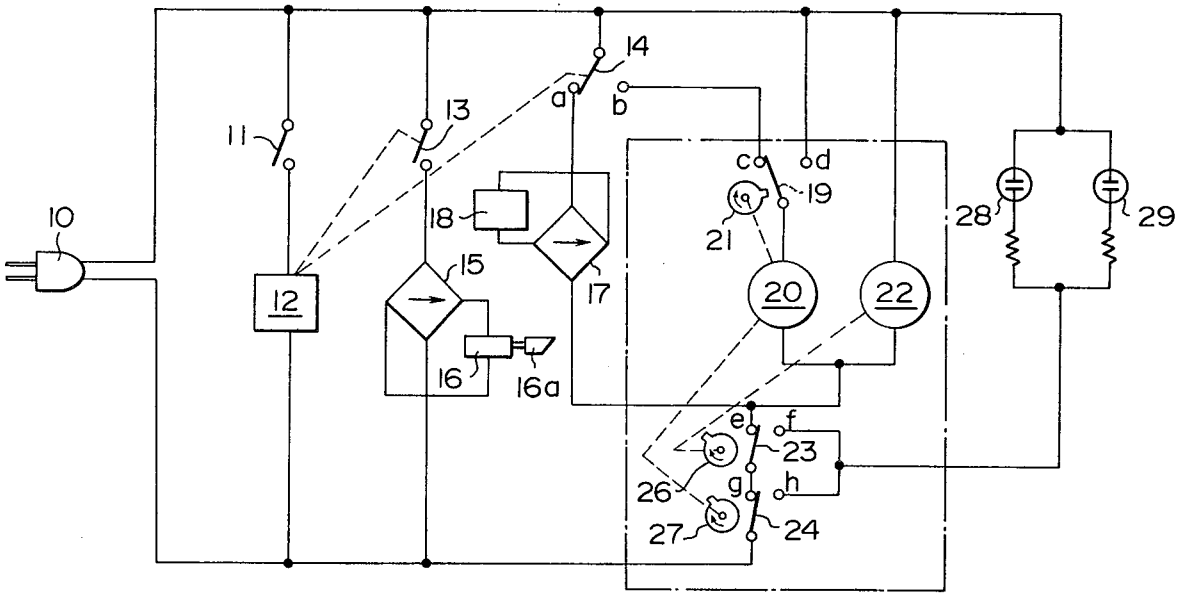
FIG. 1 shows an electric circuit of one embodiment according to this invention.

Referring to FIG. 1, there is shown an electric circuit of one embodiment according to this invention. A plug 10 is inserted in an associated receptacle (not shown), and the entire circuit is continuously connected to the commercial power source while the monitoring apparatus is used, thus assuring the continuous operation of the timer, which is later described in detail. A switch 11 and a cutting-relay 12 are connected in series to each other. After a given number of pictures (or frames) as for instance twelve pictures are taken, the switch 11 is closed for a given period of time so as to allow the cutting relay 12 to operate and put associated first and second switches 13 and 14 in closing position. A full-wave rectifier 15 is connected to the first relay switch 13, and a cutter solenoid 16 is connected to the full-wave rectifier 15. Thus, when the first relay switch 13 is closed, the cutter solenoid 16 is operated to drive the associated cutting blade 16*a*, thus cutting a constant number of successive frames bearing latent images thereon away from a roll of photographic film. The second relay switch 14 has a normally-close contact "*a*" and a normal-open contact "*b*", and when the cutting relay 12 operates, the contact arm of the switch 14 shifts from the contact "*a*" to the contact "*b*". A full-wave rectifier 17 is connected to the contact "*a*" of the switch 14, and a picture taking device 18 comprising a film driver and a shutter is connected to the full-wave rectifier 17.

The contact "*c*" of a motor hold switch 19 is connected to the contact "*b*" of the second relay switch 14. A motor 20 is for counting the number of short length of films bearing latent images, and a cam 21 is connected to the motor 20 via a gang of speed-reduction gears 20. The cam 21 when rotated, acts on the arm of the hold switch 19 to cause it to shift from the contact "*c*" to the contact "*d*" of the switch 19. Each time the motor 20 makes the full rotation, the contact arm of the switch 19 shifts from the contact "*c*" to the contact "*d*" and back to the contact "*c*". Thus, the counting motor 20 is held in the running condition until it has made one complete round.

A timer motor 22 is connected in parallel with the series-connection of the counting motor 20 and the associated hold switch 19. The timer motor 22, the counting motor 20 and the picture taking unit 18 are connected to one of the power lines via a first switch 23 and a second switch 24. The first switch 23 has two contacts "*e*" and "*f*". A first cam 26 associated with the first switch 23 is connected to the timer motor 22 via a speed-reduction mechanism so that the first cam 26 when operated, shifts the contact arm of the switch 23 from the contact "*e*" to the contact "*f*". After the timer motor 22 has continuously run for one hundred and fifty-six hours (about one week), the first cam 26, rotates a given constant angle from the start position, thus causing its projection to push and shift the contact arm of the first switch 23 from the contact "*e*" to the contact "*f*".

In a similar way to the operation of the first switch 23, the second switch 24 is operated by the second cam 27 which is connected to the counting motor 20, so that the contact arm of the switch 24 shifts from the contact "*g*" to the contact "*h*" each time the counting motor has counted a given constant number of (for instance, one hundred and sixty) short stripes of photographic film bearing latent images thereon.

The contact "*f*" of the first switch 23 and the contact "*h*" of the second switch 24 are connected to a pair of neon tubes, which are used as alarm lamps 28 and 29. When the developing liquid has been exhausted, the first or second switch 23 or 24 is operated so as to shift the contact arm thereof to the contact "*f*" or "*h*", thus putting the counter motor 20 and the timer motor 22 out of circuit with the power supply and at the same time putting the alarm lamps 28 and 29 in circuit with the power supply. When the alarm lamps 28 and 29 are lit, an indication board which reads "Renew Developper" is illuminated.

Figure 2:
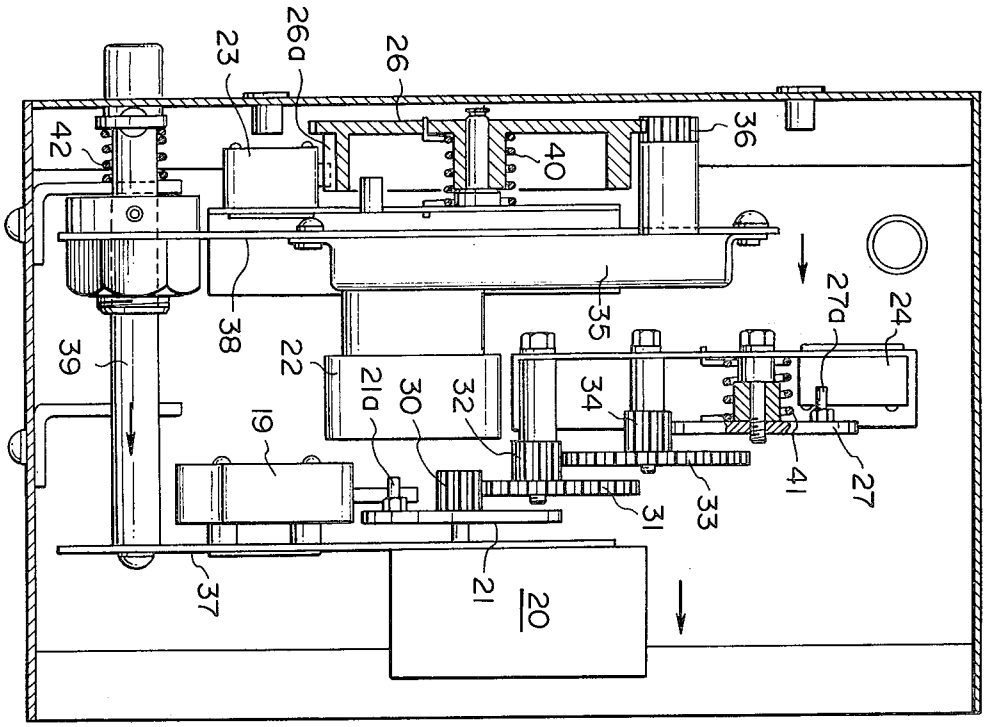
FIG. 2 shows the mechanical part of the embodiment.

The part of the circuit encircled with dot-and-dash line in FIG. 1 includes a mechanical assembly, and the structure thereof is shown in FIG. 2. As shown in FIG. 2, a gear 30 and a cam 21 are connected to the shaft of the counter motor 20. When the cam 21 rotates one revolution, the pin 21*a* of the cam 21 acts on the hold switch 19, thereby causing the hold switch 19 to shift from the contact "*c*" to the contact "*d*". The gear 30 rotates the second cam 27 at a reduced speed via a gang of speed-reduction gears 31–34. When the counter motor 20 has rotated one hundred and sixty rounds, the second cam 27 rotates such a given constant angle that the second switch 24 is opened or closed. The second cam 27 is of a gear, and the pin 27*a* of the gear acts on the second switch 24, causing its arm to shift from the contact "*g*" to the contact "*h*".

The timer motor 22 is a synchronous motor which rotates at a constant speed. A speed control 35 is connected to the timer motor 22. The first cam 26 in the form of gear engages with the gear 36 of the speed control 35. Every time one hundred and fifty six hours have passed, the first cam 26 rotates a given constant angle to cause the first switch 23 to shift from the contact "*e*" to the contact "*f*". The counter motor 20 and the switch 19 are mounted on a support plate 37, whereas the timer motor 22, the speed control 35 and the gear 36 are fixed to another support plate 38. The support plates 37 and 38 are connected to a reset rod 39, and therefore these plates are moved in the direction indicated by arrow when the reset rod 39 is pushed. The shift of the reset rod 39 causes the gear 30 and the gear 36 to disengage from the gear 31 and the first cam 26, respectively. Then, the first cam 26 and the second cam 27 return to the original position under the resilient influence of the springs 40 and 41 associated with the first and second cams 26 and 27.

The operation of the embodiment according to this invention will be described hereinbelow.

After pictures are taken on twelve frames of the photographic film roll, the switch 11 is closed for a given constant length of time, thus actuating the cutting-relay 12. As a result the first switch 13 is closed, and the contact arm of the second relay switch 14 is shifted from the contact "*a*" to the contact "*b*". The closure of the first relay switch 13 causes the cutter solenoid 16 to drive the cutter blade 16*a*, thus cutting a film strip of twelve frames long from the film roll. This twelve frame long film strip bearing latent images is processed by soaking it first in the bath of developing liquid and then in the bath of fixing liquid. Then, the processed film is discharged from the outlet of the camera processor.

When the contact arm of the second relay switch 14 is shifted to and remains on the contact "*b*" for a given constant length of time (about one second), the counter motor 20 rotates. Immediately after the counter motor 20 rotates, the pin 21*a* of the cam 21 shifts the contact arm of the hold switch 19 to the contact "*d*", thus self-holding the rotation of the counter motor 20. Upon the completion of one rotation of the motor 20 the contact arm of the switch 19 is shifted back to the contact "*c*". Prior to this stage the operation of the cutting relay 12 has terminated, and as the contact arm of the second relay switch 14 has been shifted to the contact "*a*", the counter motor 20 stops. Thus, every time a twelve frame long film strip is cut out from the film roll, the counter motor 20 rotates one round, causing the second cam 27 to rotate a given constant angle via the speed-reduction gears 31–34.

Regardless of the developing treatment of the photographic film, the timer motor 22 continuously runs, rotating the first cam 26 little by little via the speed control 35 and the gear 36, which is connected to the shaft of the speed control.

After one hundred and sixty film rolls have been processed, the pin 27*a* of the second cam 27 acts on the second switch 24, thus causing the contact arm to shift from the contact "*g*" to the contact "*h*". As a result the counter motor 20, the timer motor 22 and the picture taking device 18 are put in inoperative position, lighting the alarm lamps 28 and 29 to inform that the developing liquid must be renewed. Thus, the photographic film is prevented from being processed with the developing agent which has a lowered developing capability. While the lamps are lit, the picture taking device 18 is not in circuit with the power supply. Therefore even if a push button for taking pictures is depressed, the picture taking device 18 cannot be put in operative position.

Assume that the "effective time of the developing liquid" (156 hours) has passed before the contact arm of the second switch 24 is shifted to the contact "*h*" as mentioned above (before the amount of the film rolls processed does not reach the maximum amount (160 rolls)). The projection 26*a* of the first cam 26 actuates the first switch 23, shifting the contact arm from the contact "*e*" to the contact "*f*". As a result the alarm lamps 28 and 29 are lit, as is the case with the former deenergizing mode of operation.

After the developing liquid is renewed, the reset rod is pushed in the direction as indicated by arrow so that the gears 30 and 36 are shifted to disengage from the speed-reduction gear 31 and the first cam 26, respectively. The first and second cams 26 and 27 are reversed to the start position under the resilient influence of the springs 40 and 41. When the reset rod 39 is released, it returns to the original position under the resilient influence of the spring 42.

As is apparent from the above, a monitoring apparatus according to this invention comprises a timer to determine the length of time which has passed after the renewal of the developing liquid, a counter to determine the amount of the photographic film which has been developed, and an alarm light which is responsive to either timer or counter when having reached a predetermined position for lighting so as to inform a user that the developing liquid must be renewed. Thank to the monitoring of the developing liquid in terms of both the "effective period of time" and the amount of the photographic film rolls processed, the developing capability of the developing liquid which is being used, is maintained at a given constant level. Also, the indication in the form of lamps is easy to discern.

We claim:

1. An apparatus for monitoring the photographic processing liquid comprising an alarm lamp to indicate the renewal of said photographic processing liquid, a switching means connected in series to said alarm lamp, a timer which is adapted to act on said switch for closing after the lapse of a predetermined length of time subsequent to the renewal of said developing liquid, and a counter to count the photographic film rolls which have been developed, said counter being adapted to act on said switching means for closing the same when the total count of the photographic film rolls has reached a predetermined number, whereby the monitoring is performed in terms of both the effective period of time and the amount of the photographic film processed until said lamp indicates that said photographic processing liquid should be renewed.

2. An apparatus for monitoring the photographic processing liquid according to claim 1 wherein said timer camprises a timer motor and a cam associated therewith which is adapted to act on said switching means for closing the same when said timer motor has made a predetermined rounds.

3. An apparatus for monitoring the photographic processing liquid according to claim 1 wherein said film roll counter comprises a counter motor and cam associated therewith, said counter motor being ganged with a film cutter which is adapted to cut from a photographic film roll a given constant length of photographic film bearing latent images, and said counter motor being adapted to be energized for a given constant length of time in response to the actuation of said film cutter, and said cam being adapted to actuate on said switching means for closing the same after said counter motor has made a predetermined rounds.

4. An apparatus for monitoring the photographic liquid according to claim 2 wherein said switching means comprises a first switch which is actuated by said cam associated with said timer motor, and a second switch which is actuated by said cam associated with said counter motor, said first and second switches being connected in series to each other and being responsive to predetermined angular position of said cams for putting said timer and counter motors out of circuit with the power supply and at the same time putting said lamps in circuit with the power supply, thus causing said motors to stop and causing said lamp to light.

* * * * *